US008515627B2

(12) United States Patent
Marathe et al.

(10) Patent No.: US 8,515,627 B2
(45) Date of Patent: Aug. 20, 2013

(54) METHOD AND APPARATUS FOR CALCULATING PAYLOAD WEIGHT

(75) Inventors: Sameer S. Marathe, Naperville, IL (US); John J. Baldauf, Aurora, IL (US)

(73) Assignee: Caterpillar Inc., Peoria, IL (US)

( * ) Notice: Subject to any disclaimer, the term of this patent is extended or adjusted under 35 U.S.C. 154(b) by 760 days.

(21) Appl. No.: 12/641,639

(22) Filed: Dec. 18, 2009

(65) Prior Publication Data

US 2010/0161185 A1 Jun. 24, 2010

Related U.S. Application Data

(60) Provisional application No. 61/140,372, filed on Dec. 23, 2008.

(51) Int. Cl.

| | |
|---|---|
| ***B65G 65/04*** | (2006.01) |
| ***G01G 5/04*** | (2006.01) |
| ***G01G 19/08*** | (2006.01) |
| ***G01G 19/10*** | (2006.01) |

(52) U.S. Cl.

USPC ..... 701/50; 701/124; 702/169; 702/173; 702/174

(58) Field of Classification Search

USPC ..... 701/124, 169, 174

See application file for complete search history.

(56) References Cited

U.S. PATENT DOCUMENTS

| | | | | |
|---|---|---|---|---|
| 4,499,960 | A * | 2/1985 | Ehrich et al. | 177/25.14 |
| 4,511,974 | A * | 4/1985 | Nakane et al. | 701/124 |
| 4,627,013 | A * | 12/1986 | Ichiyama et al. | 702/174 |
| 4,981,186 | A * | 1/1991 | Shankle et al. | 177/141 |
| 4,995,468 | A | 2/1991 | Fukuda | |
| 5,067,572 | A * | 11/1991 | Kyrtsos et al. | 177/139 |
| 5,178,226 | A * | 1/1993 | Bowman et al. | 177/139 |
| 5,824,965 | A * | 10/1998 | Fujii et al. | 177/136 |
| 5,929,389 | A * | 7/1999 | Keuper | 177/141 |
| 6,082,742 | A * | 7/2000 | Ishikawa | 280/5.508 |
| 6,518,519 | B1 | 2/2003 | Crane, III et al. | |
| 6,534,728 | B1 | 3/2003 | Spikings | |
| 6,552,279 | B1 * | 4/2003 | Lueschow et al. | 177/141 |
| 6,598,010 | B2 * | 7/2003 | Zefira | 702/173 |
| 6,646,210 | B1 | 11/2003 | Wissing | |
| 7,222,444 | B2 | 5/2007 | Hendron et al. | |
| 7,247,803 | B2 | 7/2007 | Takeda et al. | |
| 7,480,579 | B2 * | 1/2009 | Lueschow et al. | 702/101 |
| 2006/0108154 | A1 | 5/2006 | Mack et al. | |
| 2007/0181350 | A1 | 8/2007 | Kranz et al. | |

OTHER PUBLICATIONS

NASA—Glenn Research Center, "Center of Gravity -cg", Apr. 4, 2004 pp. 1-3. Online location—http//www.grc.nasa.gov/WWW/K-12/airplane/cg.html.*

* cited by examiner

*Primary Examiner* — John Q Nguyen
*Assistant Examiner* — Edward Torchinsky
(74) *Attorney, Agent, or Firm* — Leydig, Voit & Mayer

(57) ABSTRACT

A machine includes a chassis, a linkage having a first end pivotally attached to the chassis at a first pivot point, and a bucket pivotally attached to a second end of the linkage at a second pivot point and rotatable about the second pivot point from a first position where gravity resists rotation of the bucket to a second position where gravity assists rotation of the bucket. A tilt actuator rotates the bucket about the pivot point and one or more sensors provide physical data of the bucket. A processor of the machine receives the physical data, determines from the physical data an equilibrium position of the bucket, determines a location of the center of gravity of the bucket with payload from the physical data and the equilibrium position, and estimates the weight of the payload based on the physical data and the location of the center of gravity.

20 Claims, 4 Drawing Sheets

METHOD AND APPARATUS FOR CALCULATING PAYLOAD WEIGHT

CROSS-REFERENCE TO RELATED APPLICATIONS

This patent application claims the benefit of U.S. Provisional Patent Application No. 61/140,372, filed Dec. 23, 2008, which is incorporated by reference.

TECHNICAL FIELD

This patent disclosure relates generally to loaders and, more particularly, to a method of calculating the payload weight of a loader.

BACKGROUND

A loader is a construction machine typically used to transport a load of material, such as aggregate construction or mining material, from one place, such as a pile of stored material, to another, such as a truck used for hauling the material to another location. For example, a loader may be used to load a dump truck full of material or to transport material from a pile to a specific place where it is used, such as trench. Typically, loaders are wheeled or tracked vehicles having a large bucket on one end and include hydraulics or other mechanisms for raising and lowering the bucket and tilting the bucket. However, a loader can also be a stationary machine that is immobile, but used to transport a load from one place to another, for example from a pile to the bed of a nearby dump truck. Generally, a loader is any device capable of using a bucket or other appropriate support structure to transport a payload from one place to another place.

Often, it is desirable to know the weight of a payload. For example, dump trucks used on the highway typically must abide by laws restricting how much weight they can carry and the restrictions are typically determined by a government highway authority. Depending on the density of the material loaded into a truck, it is possible to load more than the maximum allowed amount into the bed of the truck. In addition, loading too much weight into a truck can also cause premature wear to the truck's suspension, drive train, and other parts affected by weight. In other instances, it may be desirable to know the weight of the payload. For example, when material is sold according to weight, knowing an amount of material loaded into a truck can provide a basis to calculate a cost of the loaded material.

To determine the weight of a payload, loaders often include bucket scales. A bucket scale is a system integrated into the loader which measures the weight of a payload. Typically, bucket scales measure hydraulic pressures associated with the bucket, such as pressures present in hydraulic cylinders used for lifting the bucket up and down and for tilting the bucket about a pivot point. One problem with bucket scales is that the pressures in the relevant portions of the hydraulic system depend on the center of gravity (CG) of the payload. In particular, a payload concentrated in one location of a loader bucket may cause pressure values to be different than if the same payload is concentrated in another portion of the bucket. For instance, the same payload concentrated towards the front of a bucket will cause pressures in the relevant hydraulics to be different than if the payload is concentrated towards the back of the bucket. Consequently, as the same payload can cause varying measurements in bucket scales depending on the distribution of the payload, bucket scales can give inaccurate measurements of payload weight unless the distribution of the payload is taken into account.

SUMMARY

The disclosure describes, in one aspect, a machine comprising a chassis, a linkage having a first end pivotally attached to the chassis at a first pivot point, and a bucket pivotally attached to a second end of the linkage at a second pivot point and rotatable about the second pivot point from a first position where gravity resists rotation of the bucket to a second position where gravity assists rotation of the bucket. The machine also includes a tilt actuator for rotating the bucket about the pivot point and one or more sensors for providing physical data of the bucket. A processor of the machine receives the physical data, determines from the physical data an equilibrium position of the bucket between the first position and second position, determines a location of the center of gravity of the bucket with payload from the physical data and the equilibrium position, and estimates the weight of the payload based on the physical data and the location of the center of gravity.

DETAILED DESCRIPTION

Figure 1:
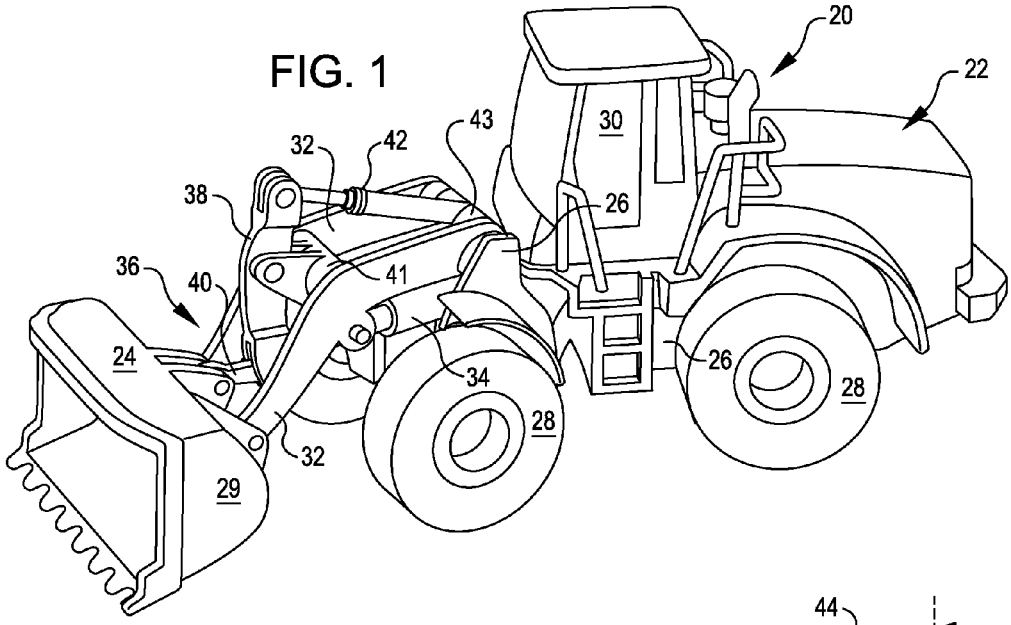
FIG. 1 is a side perspective view of a loader, in accordance with an embodiment.

Referring now to the drawings, in which like reference numerals represent like parts throughout the several views, FIG. 1 shows a loader 20 in accordance with an embodiment. The loader 20 includes a vehicle portion 22 connected to a bucket 24 on a front side of the vehicle portion 22. The vehicle portion 22, in an embodiment, includes a chassis 26 which is a frame for the vehicle portion 22, typically formed from steel or other metal. The chassis 26 supports various parts of the loader 20, either directly or indirectly, such as an engine, body panels, hydraulic systems, and other parts. The chassis 26 itself is supported by a plurality of wheels 28 rotatably connected to the chassis 26. The vehicle portion 22 also includes a cab 30 attached to an upper middle section of the chassis 26. In an embodiment, the cab 30 is an enclosed structure having windows on lateral sides and in which an operator of the loader 20 sits and operates the loader 20.

The bucket 24 is an implement located at a front portion of the loader 20. In an embodiment, the bucket 24 is made from metal and comprises two parabolic or similarly-shaped plates 29 having a metal plate curved about the perimeter of each plate and extending horizontally between them so as to form a concave enclosure opening away from the loader 20. In general, the bucket may have any shape capable of holding a payload.

In an embodiment, the bucket 24 is attached to the vehicle portion 22 by a linkage comprising a pair of parallel booms 32 extending between a back portion of the bucket 24 to another location on the chassis 26, such as at a location immediately in front of the cab 30. Each boom 32 is an elongate metallic structure pivotally attached to the chassis 26 at one end, and pivotally attached to a rear portion of the bucket 24 on an opposite end. For each boom 32, a hydraulic lift cylinder assembly 34 or other actuator for lifting the boom 32 is pivotally attached to the chassis 26 beneath the boom 32 at a location of the boom 32 between the bucket 24 and the location of the attachment of the boom 32 to the chassis 26.

In an embodiment, the lift cylinder assembly 34 is an actuator—such as a hydraulic cylinder including a rod enclosed by a casing, the rod able to extend out of or retract into the casing—able to increase and decrease its length, thereby causing its respective boom 32 to pivot upwardly about its respective attachment to the chassis 26, or retracting its length thereby forcing the boom 32 to rotate downwardly about its attachment to the chassis 26. As the booms 32 rotate about their respective attachments to the chassis 26, the bucket 24 is raised and lowered accordingly. In general, any actuator or other mechanism capable of lifting the booms 32 may be used as an alternative to or in addition to the lift cylinder assemblies 34.

In an embodiment, the bucket 24 is additionally connected to the booms 32 by a tilt linkage 36 which determines the angular position of the bucket 24 relative to the booms 32. In an embodiment, the tilt linkage 36 includes a major tilt arm 38 and a minor tilt arm 40. The major tilt arm 38 is an elongate metallic structure rotatably connected at its middle portion to a first cross member 41 extending horizontally between corresponding middle portions of the booms 32. In an embodiment, a hydraulic tilt cylinder assembly 42 or other actuator for actuating the angular position of the bucket 24 relative to the booms 32 rotatably connects an upper end of the major tilt arm 38 to a second cross member 43 extending between the booms 32 near their connections to the chassis 26. Like the lift cylinder assembly 34, the tilt cylinder assembly 42 is an actuator able to increase and decrease its length, thereby rotating the major tilt arm 38 about its connection to the first cross member 41.

The end of the major tilt arm 38 opposite the tilt cylinder assembly 42 is connected to the bucket 24 by the minor tilt arm 40, which is an elongate piece of metal extending and rotatably connected to a rear portion of the bucket 24 above the connections of the bucket 24 to the booms 32. In an embodiment, the tilt cylinder assembly 42 can extend its length, thereby, through the tilt linkage 36, causing the bucket 24 to curl with a lower front edge of the bucket 24 rotating upwardly. Similarly, the tilt cylinder assembly 42 can retract its length, thereby, through the tilt linkage 36, causing the bucket 24 to tilt with the lower front edge of the bucket 24 rotating downwardly.

Figure 2:
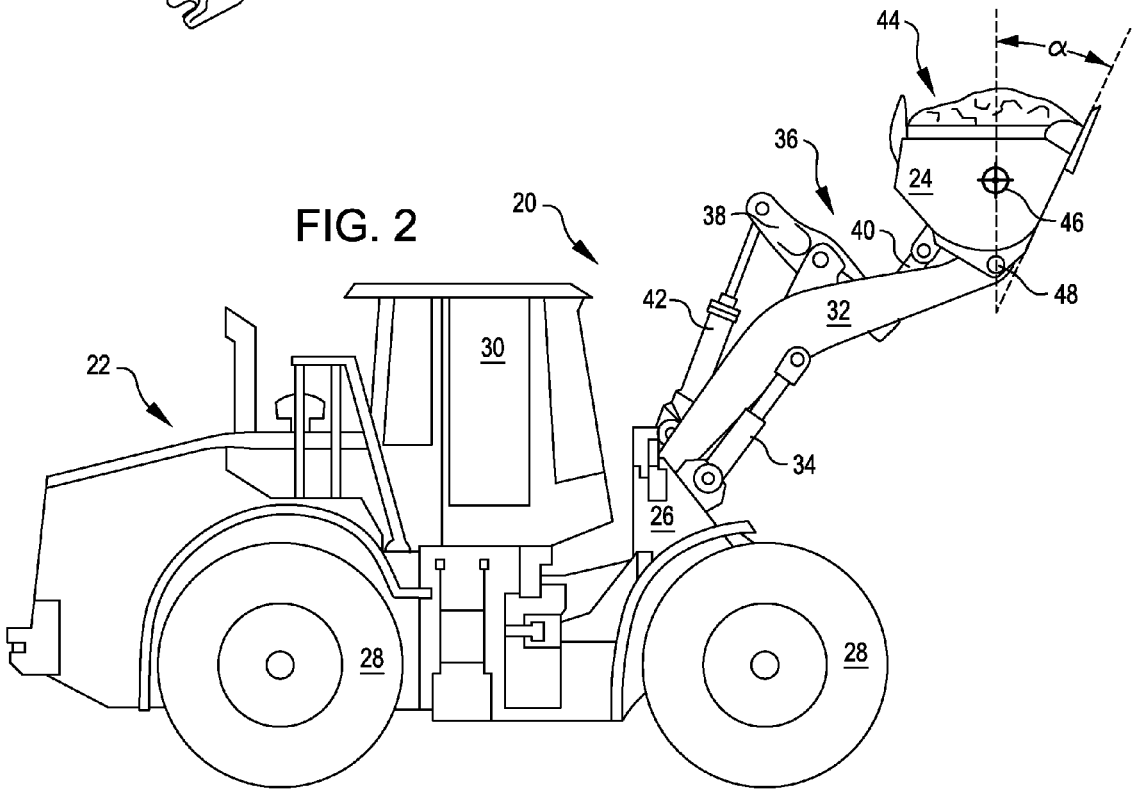
FIG. 2 is a side view of the loader of FIG. 1 with its bucket raised.

FIG. 2 shows the loader 20 with a payload 44 in the bucket 24. As shown by the crosshairs on the bucket 24, the combination of the bucket 24 and payload 44 has a center of gravity 46. In an embodiment, the center of gravity 46 is a line extending horizontally across the bucket 24 through the center of mass of cross sections of the payload 44 and bucket 24, the cross sections taken about vertical planes extending parallel to outer edges of the bucket 24. In an alternate embodiment, however, the center of gravity is a single point. As depicted in FIG. 2, the payload 44 is distributed relatively evenly throughout the bucket 24 and the loader 20 is shown in a configuration where the bucket 24 is raised off the ground and the payload 44 is balanced atop a pivot point 48 about which the tilt cylinder assembly 42 tilts the bucket 24 relative to the boom 32. The configuration shown in FIG. 2 is typically used by an operator of the loader 20 who is about to dump the payload 44 to a location off the ground, for example, the bed of a dump truck or atop a storage pile of gravel.

Figure 3:
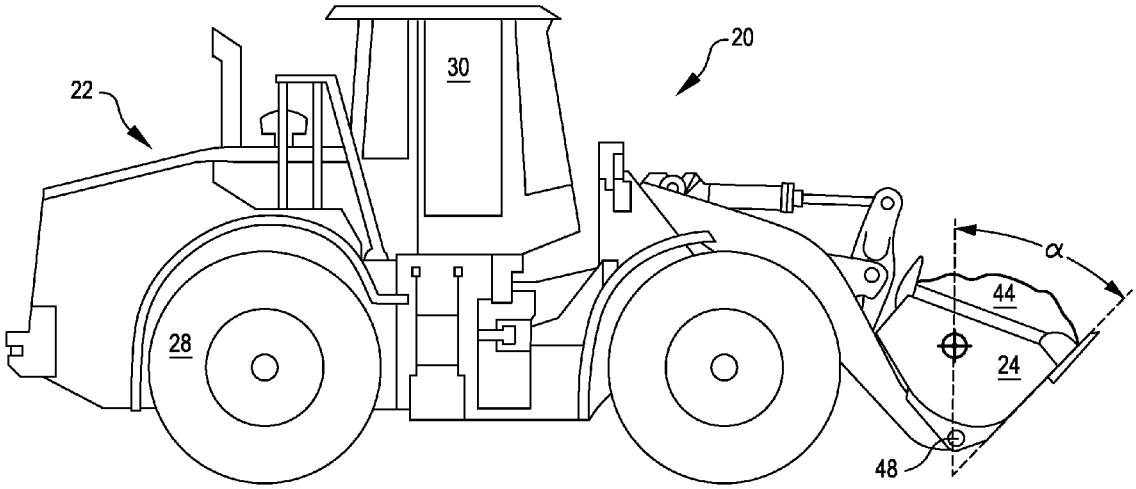
FIG. 3 is a side view of the loader of FIG. 1 with its bucket lowered.

FIG. 3 shows the loader 20 with the bucket 24 just slightly off the ground and tilted back towards the operator as far as permitted by the arrangement of the booms 32 and bucket 24. This configuration is often used by operators of the loader 20 as they drive a payload from one location to another, for example from a store of material on one side of a job site to a ditch on another side of the jobsite or from a store of material to a truck waiting to be loaded with the material.

Figure 4:
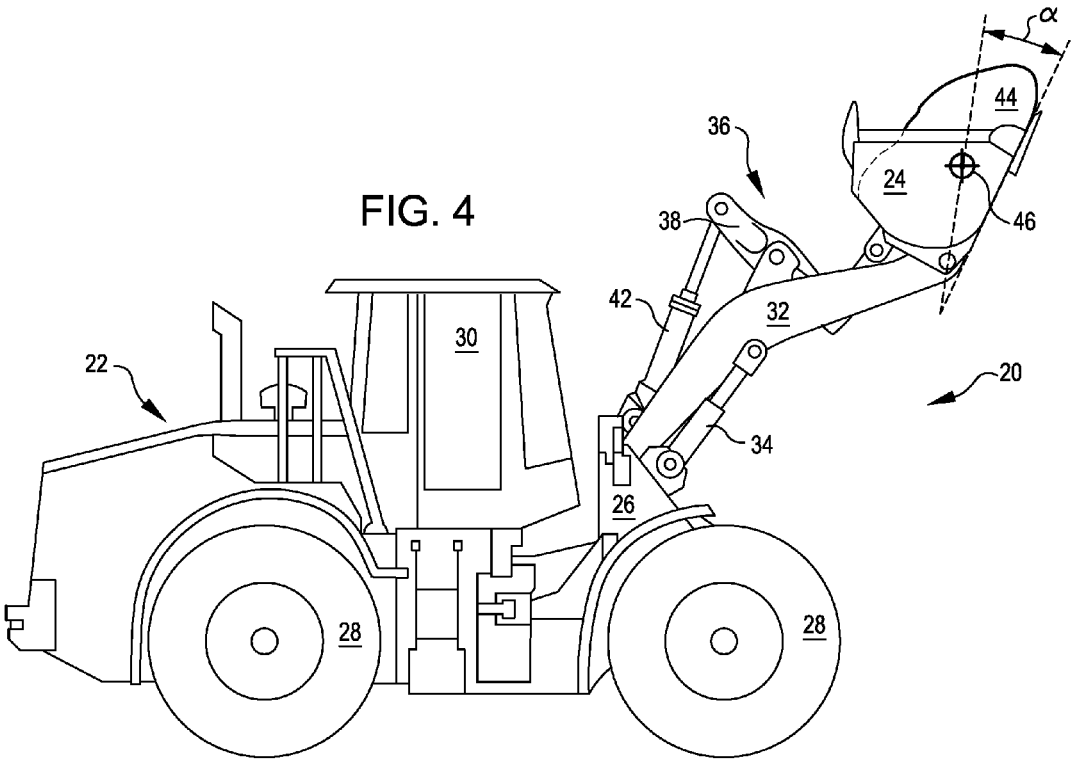
FIG. 4 is a side view of the loader of FIG. 1 with its bucket raised and its payload concentrated towards the front of the bucket.

FIG. 4 shows the loader 20 in a configuration similar to that of FIG. 2. However, in FIG. 4, the payload 44 is concentrated towards a scraping side of the bucket 24. Such distribution of the payload 44 can occur, for example, with an inexperienced operator or in situations where it is difficult for the operator to scoop the payload 44 into the bucket 24, such as when the payload 44 is collected from a small pile which does not have enough mass to effectively resist the force of the bucket moving through the pile as bucket scoops from the pile. Comparing FIGS. 2 and 4, the center of gravity 46 of the payload 44 in FIG. 4 is higher and further away from the operator of the loader 20 than is the case in FIG. 2. Thus, the pressure in the lift cylinder assembly 34 as shown in FIG. 4 is greater than is shown in FIG. 2 because the weight of the payload 44 is concentrated further from the end of the boom 32 pivotally connected to the chassis 26.

Figure 5:
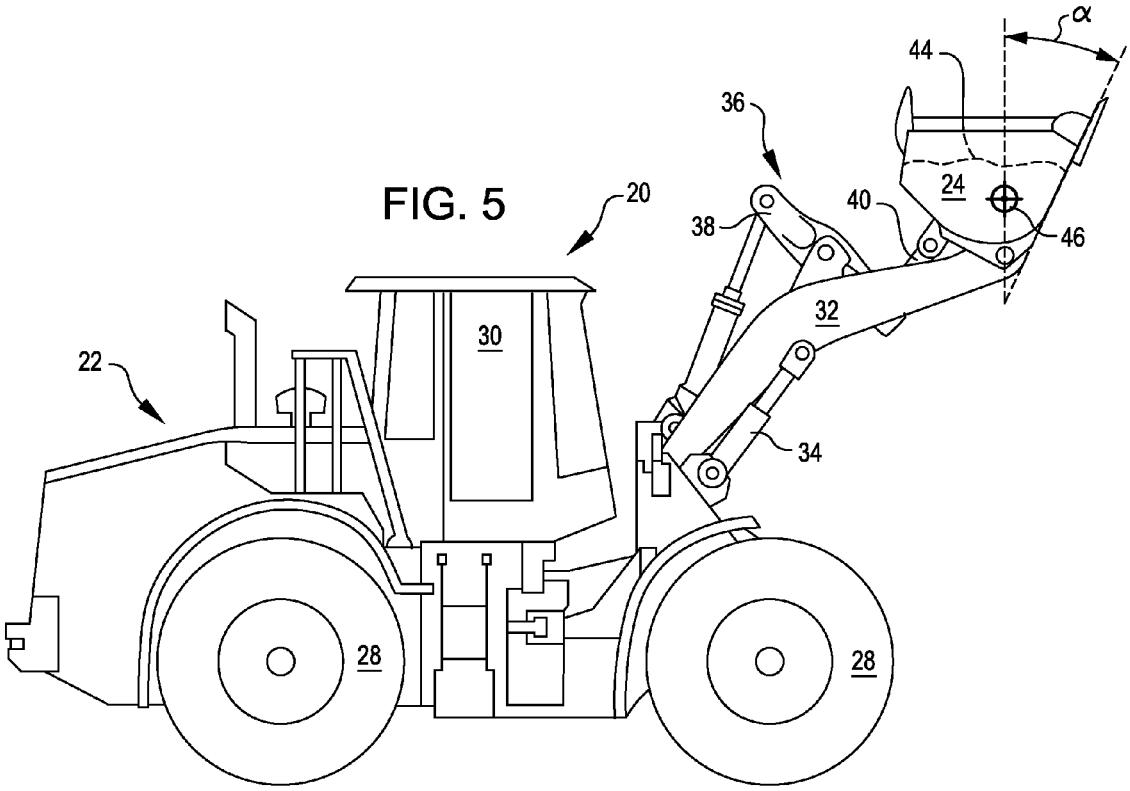
FIG. 5 is a side view of the loader of FIG. 1 with its bucket raised and a small payload centered in the bucket.

FIG. 5 shows the loader 20 in a configuration similar to that of FIGS. 2 and 4 with a smaller payload 44. With the smaller payload 44, the center of gravity 46 of the combination bucket 24 and payload 44 is lower in the bucket 24 than with a similarly distributed, but larger load.

Figure 6:
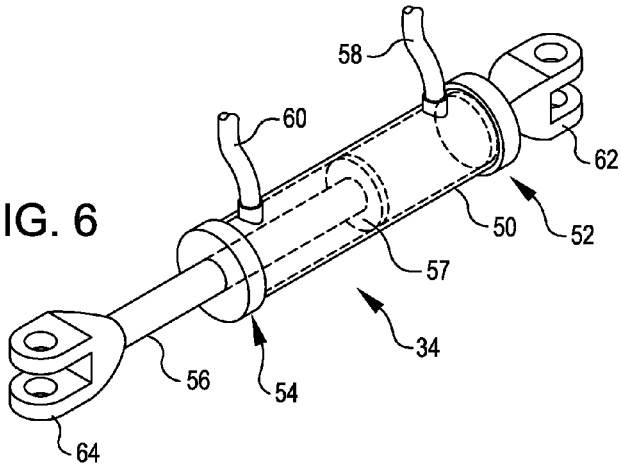
FIG. 6 is a side perspective view of a hydraulic cylinder of the loader of FIG. 1.

FIG. 6 shows a representation of a lift cylinder assembly 34. The lift cylinder assembly 34 includes a casing 50, which is a hollow, cylindrical section of rigid material such as metal capped on both ends. The lift cylinder assembly 34 includes a head-end 52 completely capped, and rod-end 54 through which an elongate metal rod 56 extends. A hydraulic head-end hose 58 is fluidly connected to the interior of the casing 50 at the head-end 52, while a hydraulic rod-end hose 60 is fluidly connected to the interior of the casing 50 at the rod-end 54. The rod 56 includes a plunger 57 at an end inside the casing 50, the plunger having a cross section approximately equal to the interior diameter of the casing 50 so as to fit tightly inside the interior of the casing 50. In this manner, a pressure differential across the head-end hose 58 and rod-end hose 60 causes the rod 56 to move relative to the casing 50. For instance, if there is higher pressure in the head-end hose 58 than in the rod-end hose 60, hydraulic fluid will force the plunger 57 towards the rod-end 54 of the cylinder 34, thereby causing the rod 56 to exit the casing 50 about its length. Hydraulic fluid in the rod-end 54 of the lift cylinder assembly 34 exits the rod-end 54 through the rod-end hose 60 to a control valve (not shown) or other component of the hydraulic system of the loader 20. Similarly, if the pressure in the rod-end hose 60 is higher than in the head-end hose 58, the plunger 57 is forced into the casing 50 away from the rod-end 54 towards the head-end 52 causing the rod 56 to retract into the casing 50.

In an embodiment, the tilt cylinder assembly 42 is functionally identical to the lift cylinder assembly 34, although it may have different dimensions such as a different length or diameter. Consequently, reference numerals for the lift cylinder assembly 34 will be used to reference respective parts of the tilt cylinder assembly 42.

Physical data concerning the bucket 24 and the payload 44 are able to be gathered through sensors on the linkage connecting the bucket 24 to the chassis 26, such as through sensors associated with the lift cylinder assembly 34 and tilt cylinder assembly 42. For example, pressures inside of head-end 52 and rod-end 54 of each lift cylinder assembly 34 and tilt cylinder assembly 42 are able to be measured by taking measurements from a suitable pressure. Likewise, the displacement of the rod 56 of each the lift cylinder assembly 34 and tilt cylinder assembly 42 can also be measured. In an embodiment, the plunger 57 includes a magnetic element that is sensed by a sensor (not shown) located on the casing 50. The sensor includes several sensing elements that react when the magnetic element is in close proximity, thereby indicating the location of the magnetic element relative to the casing 50 and, therefore, the displacement of the rod 56 relative to the casing 50. Generally, any mechanism or mechanisms for measuring the head-end 52 and rod-end 54 pressures, and rod 56 displacement can be used. In addition, by taking pressure and/or displacement measurements several times over a time period, additional data can be gathered, such as the velocity of the rod 56 as it moves relative to the casing 50, the rates of change in the head-end 52 or rod-end 54 pressures, or other related physical data.

In addition, the loader 20, as shown, includes two identical lift cylinder assemblies 34 that act in concert to raise and lower the booms 32. Consequently, pressure and displacement measurements need only be taken from one of the lift cylinder assemblies 34 in order to provide data about the bucket 24. Nevertheless, pressure and/or displacement measurements can be taken for both lift cylinder assemblies 34 in order to increase the accuracy of the measurements taken. For instance, if the loader 20 is on an uneven surface, the head-end 52 pressures in each lift cylinder assembly 34 can be unequal and the pressures can be averaged or otherwise used. In addition, taking measurements from more than one lift cylinder assembly 34 also can be used in order to provide redundancy so that sensors for one lift cylinder assembly 34 provide a reference against which to check the function of sensors of the other lift cylinder assembly 34 and so that, should sensors in one lift cylinder assembly 34 fail, sensors in the other lift cylinder assembly 34 can be used.

Figure 7:
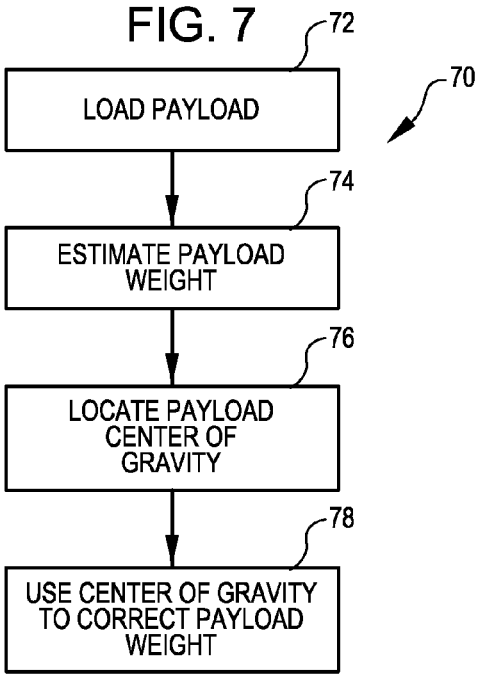
FIG. 7 is a schematic diagram of a method for estimating a bucket payload weight, in accordance with an embodiment.

FIG. 7 shows a schematic diagram of a system 70 for estimating the weight of the payload 44. It will be appreciated that each program, module, and functional computational unit described herein, and each step executed by the system 70, is implemented in an embodiment by a computer or computing device (generically "computer") using one or more processors to read computer-executable instructions from a computer-readable medium and executing said instructions or causing them to be executed. The computer-readable medium is a physical fixed medium such as a magnetic or optically readable (and potentially writable) disc, circuit, array, or other physically tangible element. In an alternative embodiment, "transient computer-readable media" may be used additionally or alternatively. Such media include radio and optical transmissions (generically "electromagnetic transmissions"), audio transmissions, whether human-perceivable or not, and so on. It will be appreciated that "computer-readable media" are distinct from "transient computer-readable media."

The system 70 begins the weight estimation at a loading step 72 during which an operator of the loader 20 loads the payload 44 into the bucket 24. Typically, loading the payload 44 into the bucket 24 involves lowering the bucket 24 to the ground and tilting the bucket 24 so that a bottom edge of the bucket 24 is approximately parallel to the ground. An operator of the loader 20 drives the loader 20 toward a pile of gravel or other material with the bucket 24 in this configuration and gradually lifts the booms 32 and curls the bucket 24 as the bucket enters the pile, thereby causing gravel in the pile to be scooped by the bucket 24. However, other ways of loading the payload 44 into the bucket 24 can also be practiced, such as loading the payload 44 into the bucket 24 manually using hand shovels or by dropping the payload 44 into the bucket 24 using another machine, such as an excavator. Generally, any method of loading a payload 44 into the bucket 24 can be used.

Once the payload 44 is loaded into the bucket 24, at a load estimation step 74, a bucket scale in the loader 20 estimates the weight of the payload 44. In an embodiment, estimating the weight of the payload 44 includes the use of an automated system which monitors hydraulic pressure in the lift cylinder assemblies 34 and tilt cylinder assemblies 42 as well as the height of the bucket 24 and angular position of the bucket 24 relative to the booms 32. In an embodiment, the automated system assumes a specific location of the center of gravity 46 of the payload 44, such as the known center of gravity of a weight used to calibrate the automated system. The height and angular position of the bucket 24, in an embodiment, is determined by measuring displacement of the rods 56 of the lift cylinder assembly 34 and tilt cylinder assembly 42 and calculating the bucket 24 height and angular position based on a predetermined geometric relationships between the displacements and the height and angular position, as established by the geometric properties of the booms 32, lift cylinder assembly 34, tilt cylinder assembly 42, chassis 26, and bucket 24. In an embodiment, the system 70 converts the pressures and positions measured into an estimated weight by referencing the pressures and positions measured in a table stored electronically in the system 70; however, the system 70 can use formulas derived from geometric properties of the loader 20 or other methods for translating measured physical data into an estimated weight. Tables stored electronically in the system 70 can be determined empirically, using measurements taken with payloads of known weight and center of gravity or by the use of well-known physical formulas.

At a center of gravity calculation step 76, the center of gravity 46 of the payload 44 is located, and at a correction step 78 the location of the center of gravity 46 is used in order to correct the estimate of the weight of the payload 44 determined in step 74. In particular, the location of the center of gravity 46 is used to provide a proper correlation between physical data of the lift cylinder assembly 34 and tilt cylinder assembly 42 and the weight of the payload 44. By knowing the angular and radial position of the center of gravity 46, as described more fully below, in comparison with angular and radial position of the center of gravity assumed above in the load estimation step 74, the system 70 can determine how the change in the position of the center of gravity 46 affects the estimate of the payload 44 weight.

For instance, by calculating that the center of gravity 46 is higher and further away relative to the chassis 26 than the assumed center of gravity, the system 70 determines that the actual payload 44 weight is less than the estimated weight and corrects the estimated weight accordingly. Likewise, if the system 70 determines that the center of gravity 46 is lower and closer relative to the chassis 26 than the assumed center of gravity, the system 70 determines that the actual payload 44 weight is more than the estimated weight and corrects the estimated weight accordingly. In an embodiment, a factor by which to multiply the estimated weight is determined by referencing an empirically-created table stored in the system 70, the table indexed by the angular location and radial location of the center of gravity 46. However, the system can also use formulas stored in the system 70 that are based on well-known physical equations and the geometry of the loader 20 in order to determine the actual payload 44 weight from the estimated weight.

In an alternate embodiment, the system 70 does not make an initial estimate of the payload 44 weight, but uses physical data collected while the loader 20 is being operated and calculates the payload 44 weight based on the calculated center of gravity of the payload 44. For instance, the system 70 can utilize a formula based on the angular and radial positions of the center of gravity 46 as well as data measured in the lift cylinder assembly 34 and tilt cylinder assembly 42 in order to determine the payload 44 weight instead of correcting an estimated weight. In an embodiment, the formula is a polynomial determined experimentally from empirical data, although it can be another formula, such as a formula based on well-known physical equations, or a discrete formula stored in the form of one or more tables.

Figure 8:
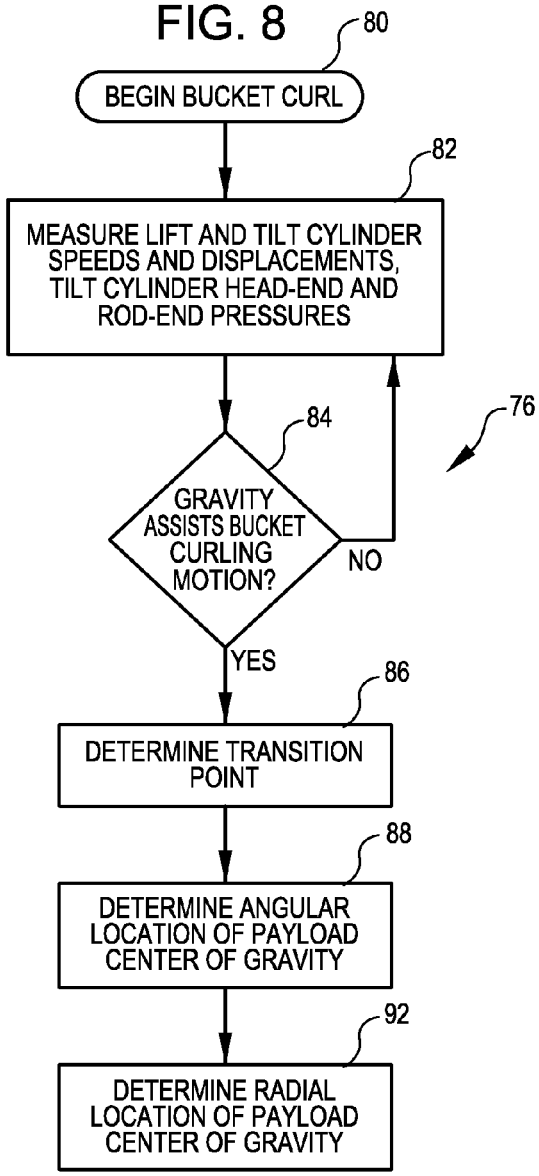
FIG. 8 is a schematic diagram of a method for locating the center of gravity of a payload, in accordance with an embodiment.

FIG. 8 shows the center of gravity calculation step 76 in more detail. At a bucket curling step 80, the bucket 24 is curled from a position where gravity resists bucket curling motion to a position where gravity assists bucket curling motion, such as from the position shown in FIG. 1 to the position shown in FIG. 3. In an embodiment, the bucket curling step 80 is completed during the normal course of operation of the loader 20, for example, while the bucket 24 is loaded and put in a position for transportation to the location where the payload 44 will be dumped or unloaded. However, the bucket curling step 80 can also be completed separately from normal loader 20 operation, for example, as an extra step taken by the operator of the loader 20.

While the bucket 24 is being curled, measurements and calculations are made and recorded. For instance, at a data gathering step 82, the lift and tilt rod 56 velocities and displacements are measured, as are the tilt cylinder head-end and rod-end pressures. At a position checking step 84, the system uses the information from the data gathering step 82 and determines whether gravity is assisting the bucket curling motion. If gravity resists the bucket 24 curling motion, the system 70 returns to the data gathering step 82. If at the position checking step 84 the system 70 determines that gravity is assisting the bucket curling motion, then the system 70 determines a transition point at a transition point step 86, the transition point being the angle at which gravity transitions from resisting the bucket curling motion to assisting the bucket curling motion, the angle depending on the displacements of the rods 56 of both the lift cylinder assembly 34 and tilt cylinder assembly 42.

At the transition point determined in the transition point step 86, the system 70 at an angular CG location step 88 determines the angular location of the payload 44 center of gravity 46. In an embodiment, system 70 measures at the transition point the angle of the line running through the center of gravity 46 of the payload 44 to the pivot point 48 relative to the line on the scraping edge of the bucket 24, the angle being represented by the letter a in FIGS. 2-5. Other angles, such as complementary angles, and other geometrically related angles can be measured instead of or in addition to the angle $\alpha$.

At a radial CG location step 92, the system 70 determines the radial location of the center of gravity 46 of the payload 44, the radial location of the center of gravity 46 being the distance of the center of gravity 46 from the pivot point 48. In an embodiment, step 92 is accomplished by taking tilt cylinder assembly 42 head-end 52 and rod-end 54 pressures recorded near the transition point 86. The rate at which the head-end and rod-end pressures change around the transition point are strongly correlated with the radial location of the center of gravity 46. Consequently, the rates of change of the pressures recorded near the transition point are calculated and referenced in a kinematic table stored in the system 70 in order to determine the radial location of the center of gravity 46. In an alternate embodiment, a formula dependent on the rates of change of the pressures recorded is used to calculate the radial location of the center of gravity 46, the formula based on the geometric and physical properties of the loader 20.

INDUSTRIAL APPLICABILITY

In a typical situation, the loader 20 is used to transfer aggregate material, such as rock or dirt, from a stockpile to a truck used for transporting the material to another location. As described above, it is often desirable to know the weight of the material loaded onto the truck. For example, several factors may limit the amount of material that can be loaded onto the truck and/or the loaded material may be sold according to weight. Generally, an operator of the loader 20 scoops several bucket loads of material and dumps the material over sideboards of the truck into a bed of the truck until the desired amount of material is loaded onto the truck.

When the operator scoops material into the bucket 24 of the loader 20 and brings the bucket 24 into a position for loading onto the truck, the system 70 measures physical data of the lift cylinder assembly 34 and tilt cylinder assembly 42 around a transition point of the bucket 24 in order to determine the center of gravity 46 of the combination of bucket 24 and payload 44, and to use the center of gravity 46 in order to correct the weight measured by a bucket scale of the loader 20 by comparing the center of gravity 46 with the center of gravity of a payload used to calibrate the bucket scale. The initial estimated payload 44 weight may be shown to the operator until the estimate is corrected according to the center of gravity 46, at which time the corrected weight is shown. Other items may also be displayed to the operator of the loader 20, such as the cumulative weight loaded onto the truck, or loaded since a particular point in time.

By knowing the weight of the payload 44, the operator of the loader 20 can determine whether to continue loading the truck. For example, if the operator knows that a particular truck is certified to carry ten tons of material in addition to the weight of the truck on public roads, the operator can determine how much weight he or she has already loaded onto the truck at a given time and how much weight he or she can load into the truck at any given time. As another example, if a customer has ordered more material than can be loaded into one truck, such as 1000 tons, the operator of the loader 20 can load several trucks until the operator sees that he or she has loaded the total weight ordered into the several trucks.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A machine, comprising:

a chassis;

a linkage having a first end pivotally attached to the chassis at a first pivot point;

a lift cylinder assembly connected to the chassis and the linkage, for rotating the linkage about the first pivot point;

a tilt cylinder assembly connected to the chassis and a bucket, for rotating the bucket about a second pivot point;

the bucket pivotally attached to a second end of the linkage at the second pivot point and rotatable about the second pivot point in a curling direction, which rotates the bucket towards the chassis from a first angular position, where gravity resists rotation of the bucket in the curling direction, to a second angular position, where gravity assists rotation of the bucket in the curling direction, the bucket for collecting and discharging a payload;

said tilt cylinder assembly for rotating the bucket about the second pivot point in the curling direction;

at least one or more pressure sensors associated with each of lift and tilt cylinder assemblies, for providing signals indicative of physical data of the bucket; and a processor configured for receiving the signal, determining from the signal an angular balance position of the bucket and its payload between the first and second angular positions, the angular balance position being an angular position of the bucket and its payload relative to the linkage at which an actual center of gravity of the bucket and its payload is vertically aligned with the second pivot point, and estimating the weight of the payload based on the signal at the angular balance position.

2. The machine of claim 1, further including a lift actuator interconnected between the chassis and the linkage, the lift actuator operating to rotate the linkage relative to the chassis for raising and lowering the bucket relative to the chassis.

3. The machine of claim 2, wherein the lift actuator and tilt actuator each have a head-end and a rod-end and wherein the physical data include velocity and displacement of the tilt actuator and lift actuator and head-end pressure and rod-end pressure of the tilt actuator.

4. The machine of claim 1, wherein the tilt actuator has a head-end and a rod-end and wherein the physical data includes at least one parameter selected from the group consisting of: velocity, displacement, head-end pressure, and rod-end pressure of the tilt actuator.

5. The machine of claim 4, wherein the processor is further configured to determine a radial distance of the actual center of gravity of the bucket with payload with respect to the second pivot point using head-end pressure measurements and rod-end pressure measurements around the angular balance position in order to reference a kinematic table.

6. The machine of claim 1, further including a display for displaying a payload weight to an operator of the machine.

7. The machine of claim 5, wherein the processor calculates an initial payload weight estimate based on the signal and determines the weight of the payload by correcting the weight estimate based on the angular balance position and radial location of the actual center of gravity.

8. The machine of claim 7, wherein the initial payload weight estimate is additionally based on a calibration payload.

9. A method for calculating the weight of a payload in a bucket of a machine, the bucket linked to a chassis by a linkage, the linkage attached to the chassis at a first pivot point and being pivotable about a first pivot axis running through the first pivot point, and the bucket pivotally attached to the linkage at a second pivot point and being pivotable about a second pivot axis running through the second pivot point, a lift cylinder assembly connected to the chassis and the linkage, for rotating the linkage about the first pivot point; a tilt cylinder assembly connected to the chassis and the bucket, for rotating the bucket about a second pivot point;

the method comprising:

curling the bucket and its payload past an angular balance position, the angular balance position being between a first angular position, where gravity resists curling the bucket, and a second angular position, where gravity assists curling the bucket and its payload, wherein at the angular balance position, an actual center of gravity of the bucket and its payload is vertically aligned with the second pivot axis; and capturing physical data of the bucket from at least one or more pressure sensors associated with each of lift and tilt cylinder assemblies, for providing signals indicative of physical data of the bucket to determine the angular balance position relative to the second pivot axis; and determining the weight of the payload from the physical data at the angular balance position.

10. The method of claim 9, further including calculating an initial estimate of the weight and wherein determining the weight includes determining a correction factor from the physical data, the correction factor for calculating the weight from the initial estimate.

11. The method of claim 10, wherein the correction factor is based on a center of gravity of the combined bucket and payload, the center of gravity determined from the physical data near the angular balance position.

12. The method of claim 11, wherein the machine includes a bucket scale and wherein the correction factor is additionally based on a center of gravity of a calibration payload used to calibrate the bucket scale.

13. The method of claim 9, wherein the machine includes a lift actuator for lifting the bucket and a tilt actuator for tilting the bucket, the tilt actuator having a head-end and a rod-end, and wherein the physical data include velocity and displacement of the tilt actuator and lift actuator and head-end pressure and rod-end pressure of the tilt actuator.

14. The method of claim 13, further including locating a radial distance of the actual center of gravity of the bucket and payload with respect to the second pivot axis using head-end pressure measurements and rod-end pressure measurements around the angular balance position in order to reference a kinematic table.

15. The method of claim 9, further including locating a radial distance from the second pivot axis and an angular displacement with respect to the angular balance position of the actual center of gravity of the combined bucket and payload.

16. The method of claim 9, further including displaying the weight to an operator of the machine.

17. The method of claim 16, further including displaying an initial estimated weight to the operator of the machine prior to displaying the weight to the operator.

18. A system for estimating the weight of a payload in a bucket of a machine, the machine comprising:

a chassis;

a linkage having a first end pivotally attached to the chassis at a first pivot point;

a lift cylinder assembly connected to the chassis and the linkage, for rotating the linkage about a first axis running through the first pivot point;

a tilt cylinder assembly connected to the chassis and a bucket, for rotating the bucket about a second axis running through a second pivot point;

the bucket pivotally attached to a second end of the linkage at the second pivot point and rotatable about the second pivot point in a curling direction, which rotates the bucket towards the chassis from a first angular position, where gravity resists rotation of the bucket in the curling direction, to a second angular position, where gravity assists rotation of the bucket in the curling direction, the bucket for collecting and discharging a payload;

at least one or more pressure sensors associated with each of lift and tilt cylinder assemblies, for providing signals indicative of physical data of the bucket one or more sensors for providing physical data of the bucket and linkage;

a processor configured for receiving the signals, for determining an angular balance position of the bucket and its payload relative to the second pivot axis from the physical data, the angular balance position disposed at an angular position in which an actual center of gravity of the bucket and its payload is vertically aligned with the second pivot axis, and for determining the weight of the payload based on the physical data at the angular balance position; and a display for displaying the weight of the payload.

19. The system of claim 18, wherein the machine includes a lift actuator for lifting the bucket and a tilt actuator for tilting the bucket, the tilt actuator having a head-end and a rod-end, and wherein the physical data include velocity and displacement of the tilt actuator and lift actuator and head-end pressure and rod-end pressure of the tilt actuator.

20. The system of claim 19, wherein the processor calculates an estimate of the weight based on the physical data and corrects the estimate based on the angular balance position of the actual center of gravity of the combined bucket and payload.

* * * * *